US008767989B2

(12) United States Patent
Burns et al.

(10) Patent No.: US 8,767,989 B2
(45) Date of Patent: Jul. 1, 2014

(54) METHOD AND APPARATUS FOR A HEARING ASSISTANCE DEVICE USING MEMS SENSORS

(75) Inventors: Thomas Howard Burns, Chaska, MN (US); Matthew Green, Chaska, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 1066 days.

(21) Appl. No.: 12/233,356

(22) Filed: Sep. 18, 2008

(65) Prior Publication Data

US 2009/0097683 A1 Apr. 16, 2009

Related U.S. Application Data

(60) Provisional application No. 60/973,399, filed on Sep. 18, 2007.

(51) Int. Cl.
*H04R 25/00* (2006.01)

(52) U.S. Cl.
USPC ..... 381/322; 381/324; 381/326; 381/328

(58) Field of Classification Search
USPC ..... 381/326, 328, 322, 324
See application file for complete search history.

(56) References Cited

U.S. PATENT DOCUMENTS

| | | | | |
|---|---|---|---|---|
| 4,598,585 | A | 7/1986 | Boxenhorn et al. | |
| 5,091,952 | A * | 2/1992 | Williamson et al. | 381/318 |
| 5,390,254 | A | 2/1995 | Adelman | |
| 5,692,059 | A * | 11/1997 | Kruger | 381/151 |
| 5,796,848 | A * | 8/1998 | Martin | 381/320 |
| 6,310,556 | B1 | 10/2001 | Green et al. | |
| 6,330,339 | B1 * | 12/2001 | Ishige et al. | 381/312 |
| 6,631,197 | B1 * | 10/2003 | Taenzer | 381/316 |
| 7,209,569 | B2 * | 4/2007 | Boesen | 381/380 |
| 7,289,639 | B2 * | 10/2007 | Abel et al. | 381/312 |
| 7,433,484 | B2 | 10/2008 | Asseily et al. | |
| 7,778,434 | B2 * | 8/2010 | Juneau et al. | 381/328 |
| 7,983,435 | B2 * | 7/2011 | Moses | 381/326 |
| 8,005,247 | B2 * | 8/2011 | Westerkull | 381/318 |
| 2001/0007050 | A1 * | 7/2001 | Adelman | 600/150 |
| 2006/0029246 | A1 * | 2/2006 | Boesen | 381/326 |

(Continued)

FOREIGN PATENT DOCUMENTS

| | | | |
|---|---|---|---|
| EP | 1063837 | A2 | 12/2000 |
| EP | 2040490 | B1 | 11/2012 |

(Continued)

OTHER PUBLICATIONS

"European Application Serial No. 08253052.8, Extended European Search Report mailed May 6, 2010", 6 pgs.

(Continued)

*Primary Examiner* — Eugene Lee
(74) *Attorney, Agent, or Firm* — Schwegman, Lundberg & Woessner, P.A.

(57) ABSTRACT

The present subject application relates to hearing assistance systems and in particular to a method and apparatus for detecting user activities from within a hearing assistance system using micro electro-mechanical structure sensors. Such benefits include the reduction of the ampclusion effect and other excessive sound pressure buildup in the residual air volume of the ear canal for a person wearing a hearing assistance device with an earmold.

20 Claims, 6 Drawing Sheets

(56) References Cited

U.S. PATENT DOCUMENTS

| | | | | |
|---|---|---|---|---|
| 2006/0159297 | A1 | 7/2006 | Wirola et al. | |
| 2006/0280320 | A1 | 12/2006 | Song et al. | |
| 2007/0036348 | A1 | 2/2007 | Orr | |
| 2007/0053536 | A1 * | 3/2007 | Westerkull | 381/326 |
| 2007/0167671 | A1 | 7/2007 | Miller, III | |
| 2008/0205679 | A1 | 8/2008 | Darbut et al. | |
| 2010/0172523 | A1 | 7/2010 | Burns et al. | |
| 2010/0172529 | A1 | 7/2010 | Burns et al. | |

FOREIGN PATENT DOCUMENTS

| | | | |
|---|---|---|---|
| WO | WO-0057616 | A2 | 9/2000 |
| WO | WO-2004057909 | A2 | 7/2004 |
| WO | WO-2004092746 | A1 | 10/2004 |
| WO | WO-2006076531 | A2 | 7/2006 |

OTHER PUBLICATIONS

"European Application Serial No. 08253052.8, Response filed Dec. 1, 2010", 14 pgs.
Kuk, F., et al., "Ampclusion Management 101: Understanding Variables", The Hearing Review, (Aug. 2002), 6 pages.
Kuk, F., et al., "Ampclusion Management 102: A 5-Step Protocol", The Hearing Review, (Sep. 2002), 6 pages.
"U.S. Appl. No. 12/649,618, Non Final Office Action mailed Nov. 14, 2011", 7 pgs.
"U.S. Appl. No. 12/649,634, Non Final Office Action mailed Dec. 15, 2011", 10 pgs.
"U.S. Appl. No. 12/649,618, Advisory Action mailed Oct. 2, 2012", 3 pgs.
"U.S. Appl. No. 12/649,618, Final Office Action mailed Jun. 14, 2012", 12 pgs.
"U.S. Appl. No. 12/649,618, Final Office Action mailed Aug. 15, 2013", 17 pgs.
"U.S. Appl. No. 12/649,618, Non Final Office Action mailed Dec. 14, 2012", 16 pgs.
"U.S. Appl. No. 12/649,618, Response filed Apr. 16, 2012 to Non Final Office Action mailed Nov. 14, 2011", 6 pgs.
"U.S. Appl. No. 12/649,618, Response filed May 14, 2013 to Non Final Office Action mailed Dec. 14, 2012", 9 pgs.
"U.S. Appl. No. 12/649,618, Response filed Sep. 13, 2012 to Final Office Action mailed Jun. 14, 2012", 10 pgs.
"U.S. Appl. No. 12/649,634, Advisory Action mailed Sep. 26, 2012", 3 pgs.
"U.S. Appl. No. 12/649,634, Final Office Action mailed Jun. 15, 2012", 13 pgs.
"U.S. Appl. No. 12/649,634, Final Office Action mailed Aug. 15, 2013", 18 pgs.
"U.S. Appl. No. 12/649,634, Non Final Office Action mailed Dec. 14, 2012", 18 pgs.
"U.S. Appl. No. 12/649,634, Response filed Apr. 16, 2012 to Non Final Office Action mailed Dec. 15, 2011", 8 pgs.
"U.S. Appl. No. 12/649,634, Response filed May 14, 2013 to Non Final Office Action mailed Dec. 14, 2012", 9 pgs.
"U.S. Appl. No. 12/649,634, Response filed Sep. 17, 2012 to Final Office Action mailed Jun. 15, 2012", 11 pgs.
U.S. Appl. No. 12/649,618 , Response filed Oct. 15, 2013 to Final Office Action mailed Aug. 15, 2013, 11 pages.
U.S. Appl. No. 12/649,618, Advisory Action mailed Oct. 28, 2013, 3 pages.
U.S. Appl. No. 12/649,618, Examiner Interview Summary mailed Dec. 27, 2013, 3 pages.
U.S. Appl. No. 12/649,634 , Response filed Oct. 15, 2013 to Final Office Action mailed Aug. 15, 2013, 11 pages.
U.S. Appl. No. 12/649,634, Advisory Action mailed Oct. 28, 2013, 3 pages.
U.S. Appl. No. 12/649,634, Examiner Interview Summary mailed Dec. 27, 2013, 3 pages.
European Application Serial No. [Pending], Notice of Opposition mailed Aug. 6, 2013, 48 pages.
European Application Serial No. 12191166.3, Partial European Search Report mailed Oct. 9, 2013, 5 pages.

* cited by examiner

METHOD AND APPARATUS FOR A HEARING ASSISTANCE DEVICE USING MEMS SENSORS

RELATED APPLICATIONS

This application claims priority under 35 U.S.C 119(e) of U.S. Provisional Patent Application Ser. No. 60/973,399 filed on Sep. 18, 2007 which is incorporated by reference herein in its entirety.

FIELD

This application relates generally to hearing assistance systems and in particular to a method and apparatus for detecting user activities from within a hearing aid using sensors employing micro electro-mechanical structures (MEMS).

BACKGROUND

For hearing aid users, certain physical activities induce low-frequency vibrations that excite the hearing aid microphone in such a way that the low frequencies are amplified by the signal processing circuitry thereby causing excessive buildup of unnatural sound pressure within the residual ear-canal air volume. The hearing aid industry has adapted the term "ampclusion" for these phenomena as noted in "Ampclusion Management 101: Understanding Variables" *The Hearing Review*, pp. 22-32, August (2002) and "Ampclusion Management 102: A 5-step Protocol" The Hearing Review, pp. 34-43, September (2002), both authored by F. Kuk and C. Ludvigsen. In general, ampclusion can be caused by such activities as chewing or heavy footfall motion during walking or running. These activities induce structural vibrations within the user's body that are strong enough to be sensed by a MEMS accelerometer that is properly positioned within the earmold of a hearing assistance device. Another user activity that can excite such a MEMS accelerometer is simple speech, particularly the vowel sounds of [i] as in piece and [u] is as in rule and annunciated according to the International Phonetic Alphabet. Yet another activity that can be sensed by a MEMS accelerometer is automobile motion or acceleration, which is commonly perceived as excessive rumble by passengers wearing hearing aids. Automobile motion is unique from the previously-mentioned activities in that its effect, i.e., the rumble, is generally produced by acoustical energy propagating from the engine of the automobile to the microphone of the hearing aid. The output signal(s) of a MEMS accelerometer can be processed such that the device can detect automobile motion or acceleration relative to gravity. One additional user activity, not related to ampclusion, that can be detected by a MEMS accelerometer is head tilt. Finally, it should be noted that a MEMS gyrator or a MEMS microphone can be used to detect all of the above-referenced user activities instead of a MEMS accelerometer. It is understood that a MEMS acoustical microphone may be modified to function as a mechanical or vibration sensor. For example, in one embodiment the acoustical inlet of the MEMS microphone is sealed. Other techniques modifying an acoustical microphone may be employed without departing from the scope of the present subject matter. In addition to the translational acceleration estimates provided by a MEMS accelerometer, a MEMS gyrator provides three additional rotational acceleration estimates.

Thus, there is a need in the art for a detection scheme that can reliably identify user activities and trigger the signal processing algorithms and circuitry to process, filter, and equalize their signal so as to mitigate the undesired effects of ampclusion and other user activities. In all of the activities described in the previous paragraph, the MEMS device acts as a detection trigger to alert the hearing aid's signal processing algorithm to specific user activities thereby allowing the algorithm to filter and equalize its frequency response according to each activity. Such a detection scheme should be computationally efficient, consume low power, require small physical space, and be readily reproducible for cost-effective production assembly.

SUMMARY

The above-mentioned problems and others not expressly discussed herein are addressed by the present subject matter and will be understood by reading and studying this specification. The present system provides methods and apparatus to detect various motion events that effect audio signal processing and apply appropriate filters to compensate audio processing related to the detected motion events. In one embodiment an apparatus is provided with a micro electro-mechanical structure (MEMS) to sense motion and a processor to compare the sensed motion to signature motion events and provide further processing to adjust filters to compensate for audio effects resulting from the detected motion events.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

BRIEF DESCRIPTION OF THE DRAWINGS

Various embodiments are illustrated by way of example in the figures of the accompanying drawings. Such embodiments are demonstrative and not intended to be exhaustive or exclusive embodiments of the present subject matter.

DETAILED DESCRIPTION

Figure 1:
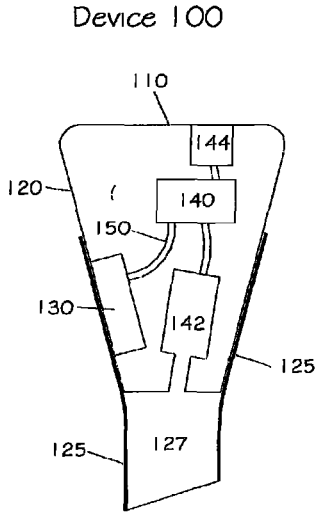
FIG. 1 shows a side cross-sectional view of an in-the-ear hearing assistance device according to one embodiment of the present subject matter.

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and therefore not exhaustive, and the scope of the present subject matter is defined by the appended claims and their legal equivalents.

There are many benefits in using the output(s) of a properly-positioned MEMS accelerometer as the detection sensor for user activities. Consider, for example, that the sensor output is not degraded by acoustically-induced ambient noise; the user activity is detected via a structural path within the user's body. Detection and identification of a specific event typically occurs within approximately 2 msec from the beginning of the event. For speech detection, a quick 2 msec detection is particularly advantageous. If, for example, a hearing aid microphone is used as the speech detection sensor, a (≈0.8 msec) time delay would exist due to acoustical propagation from the user's vocal chords to the user's hearing aid microphone thereby intrinsically slowing any speech detection sensing. This 0.8 msec latency is effectively eliminated by the structural detection of a MEMS accelerometer sensor in an earmold. Considering that a DSP circuit delay for a typical hearing aid is ≈5 msec, and that a MEMS sensor positively detects speech within 2 msec from the beginning of the event, the algorithm is allowed ≈3 msec to implement an appropriate filter for the desired frequency response in the ear canal. These filters can be, but are not limited to, low order high-pass filters to mitigate the user's perception of rumble and boominess.

The most general detection of a user's activities can be accomplished by digitizing and comparing the amplitude of the output signal(s) of the MEMS accelerometer to some predetermined threshold. If the threshold is exceeded, the user is engaged in some activity causing higher acceleration as compared to a quiescent state. Using this approach, however, the sensor cannot distinguish between a targeted, desired activity and any other general motion, thereby producing "false triggers" for the desired activity. A more useful approach is to compare the digitized signal(s) to stored signature(s) that characterize each of the user events, and to compute a (squared) correlation coefficient between the real-time signal and the stored signals. When the coefficient exceeds a predetermined threshold for the correlation coefficient, the hearing aid filtering algorithms are alerted to a specific user activity, and the appropriate equalization of the frequency response is implemented. The squared correlation coefficient $\gamma^2$ is defined as:

$$\gamma^2(x) = \frac{\sum_s [f_1(s)f_2(s)] - n\overline{f_1(s)}\,\overline{f_2(s)}}{\sum_s f_1^2(s) - n\overline{f_1^2(s)}\sum_s f_2^2(s) - n\overline{f_2^2(s)}}$$

where x is the sample index for the incoming data, $f_1$ is the last n samples of incoming data, $f_2$ is the n-length signature to be recognized, and s is indexed from 1 to n. Vector arguments with overstrikes are taken as the mean value of the array, i.e., $$\overline{f_1(s)} = \frac{\sum_s f_1(s)}{n}$$

There are many benefits in using the squared correlation coefficient as the detection threshold for user activities. Empirical data indicate that merely 2 msec of digitized information (an n value of 24 samples at a sampling rate of 12.8 kHz) are needed to sufficiently capture the types of user activities described previously in this discussion. Thus, five signatures having 24 samples at 8 bits per sample require merely 960 bits of storage memory within the hearing aid. It should be noted that the cross correlation computation is immune to amplitude disparity between the stored signatures $f_1$ and the signature to be identified $f_2$. In addition, it is computed completely in the time domain using basic $\{+ - \times \div\}$ operators, without the need for computationally-expensive butterfly networks of a DFT. Empirical data also indicate that the detection threshold is the same for all activities, thereby reducing detection complexity.

Although a single MEMS sensor is used, the sensing of various user activities is typically exclusive, and separate signal processing schemes can be implemented to correct the frequency response of each activity. The types of user activities that can be characterized include speech, chewing, footfall, head tilt, and automobile de/acceleration. Speech vowels of [i] as in piece and [u] is as in rule typically trigger a distinctive sinusoidal acceleration at their fundamental formant region of a (few) hundred hertz, depending on gender and individual physiology. Chewing typically triggers a very low frequency (<10 Hz) acceleration with a unique time signature. Although chewing of crunchy objects can induce some higher frequency content that is superimposed on top of the low frequency information, empirical data have indicated that it has negligible effect on detection precision. Footfall too is characterized by low frequency content, but with a time signature distinctly different from chewing. Head tilt can be detected by low-pass filtering and differentiating the output signals from a multi-axis MEMS accelerometer.

The MEMS accelerometer can be designed to detect any or all of the three translational acceleration components of a rectangular coordinate system. Typically, a dedicated microsensor is used in a 3-axis MEMS accelerometer to detect both the x and y components of acceleration, and a different microsensor is used to detect the z component. In our application, a 3-axis accelerometer in the earmold could be orientated such that the relative z component is approximately parallel with the relatively-central axis of the ear canal, and the x and y components define a plane that is relatively perpendicular to the surface of the earmold in the immediate vicinity of the ear canal tip. Alternatively, the MEMS accelerometer could be orientated such that the x and y components define any relative plane that is tangent to the surface of the earmold in the immediate vicinity of side of the ear canal, and the z component points perpendicularly inward towards the interior of the earmold. Although specific orientations have been described herein, it will be appreciated by those of ordinary skill in the art that other orientations are possible without departing from the scope of the present subject matter. In each of these orientations, a calibration procedure can be performed in-situ during the hearing aid fitting process. For example, the user could be instructed during the fitting/calibration process to do the following: 1) chew a nut, 2) chew a soft sandwich, 3) speak the phrase: "teeny weeny blue zucchini", 4) walk a known distance briskly. These events are digitized and stored for analysis, either on board the hearing aid itself or on the fitting computer following some data transfer process. An algorithm clips and conditions the important events and these clipped events are stored in the hearing aid as "target" events. The MEMS detection algorithm is engaged and the (4) activities described above are repeated by the user. Detection thresholds for the squared correlation coefficient and ampclusion filtering characteristics are adjusted until positive identification and perceived sound quality is acceptable to the user. The adjusted thresholds for each individual user will depend on the orientation of the MEMS accelerometer, the number of active axes in the MEMS accelerometer, and the relative strength of signal to noise. For the walking task, the accelerometer can be calibrated as a pedometer, and the hearing aid can be used to inform the user of accomplished walking distance status. In addition, head tilt could be calibrated by asking the user to do the following from a standing or sitting position looking straight ahead: 1) rotate the head slowly to the left or right, and 2) rotate the head such that the user's eyes are pointing directly upwards. These events are digitized as done previously, and the accelerometer output is filtered, conditioned, and differentiated appropriately to give an estimate of head tilt in units of mV output per degree of head tilt, or some equivalent. This information could be used to adjust head related transfer functions, or as an alert to a notify that the user has fallen or is falling asleep.

It is understood that a MEMS accelerometer or gyrator can be employed in either a custom earmold in various embodiments, or a standard earmold in various embodiments. Although specific embodiments have been illustrated and described herein, it will be appreciated by those of ordinary skill in the art that other embodiments are possible without departing from the scope of the present subject matter.

FIG. 1 shows a side cross-sectional view of an in-the-ear (ITE) hearing assistance device according to one embodiment of the present subject matter. It is understood that FIG. 1 is intended to demonstrate one application of the present subject matter and that other applications are provided. FIG. 1 relates to the use of a MEMS accelerometer mounted rigidly to the inside shell of an ITE (in-the-ear) hearing assistance device. However, it is understood that the MEMS accelerometer design of the present subject matter may be used in other devices and applications. One example is the earmold of a BTE (behind-the-ear) hearing assistance device, as demonstrated by FIG. 2. The present MEMS accelerometer design may be employed by other hearing assistance devices without departing from the scope of the present subject matter.

Figure 1A:
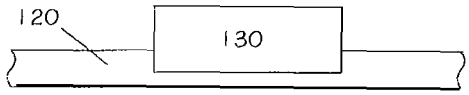
FIG. 1A illustrates a MEMS sensor mounted halfway into the shell of a hearing assistance device according to one embodiment of the present subject matter.
Figure 1B:
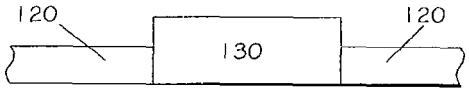
FIG. 1B illustrates a MEMS sensor mounted flush with the shell of a hearing assistance device according to one embodiment of the present subject matter.

The ITE device 100 of the embodiment illustrated in FIG. 1 includes a faceplate 110 and an earmold shell 120 which is positioned snugly against the skin 125 of a user's ear canal 127. A MEMS sensor 130 is rigidly mounted to the inside of an earmold shell 120 and connected to the hybrid integrated electronics 140 with electrical wires or a flexible circuit 150. The electronics 140 include a receiver (loudspeaker) 142 and microphone 144. Other placements and mountings for MEMS accelerometer 130 are possible without departing from the scope of the present subject matter. In various embodiments, the MEMS sensor 130 is partially embedded in the plastic of earmold shell 120 as shown in FIG. 1A, or fully embedded in the plastic so that is it flush with the exterior of earmold shell 120 as shown in FIG. 1B. With this approach, structural waves are detected by sensor 120 via mechanical coupling to the skin 125 of a user's ear canal 127. An analogous electrical signal is sent to electronics 140, processed, and used in an algorithm to detect various user activities. It is understood that the electronics 140 may include known and novel signal processing electronics configurations and combinations for use in hearing assistance devices. Different electronics 140 may be employed without departing from the scope of the present subject matter. Such electronics may include, but are not limited to, combinations of components such as amplifiers, multi-band compressors, noise reduction, acoustic feedback reduction, telecoil, radio frequency communications, power, power conservation, memory, multiplexers, analog integrators, operational amplifiers, and various forms of digital and analog signal processing electronics.

It is understood that the MEMS sensor 130 shown in FIG. 1 is not necessarily drawn to scale. Furthermore, it is understood that the location of the MEMS accelerometer 130 may be varied to achieve desired effects and not depart from the scope of the present subject matter. Some variations include, but are not limited to, locations on faceplate 110, sandwiched between receiver 142 and earmold shell 120 so as to create a rigid link between the receiver and the shell, or embedded within the hybrid integrated electronic circuit 140.

Figure 2:
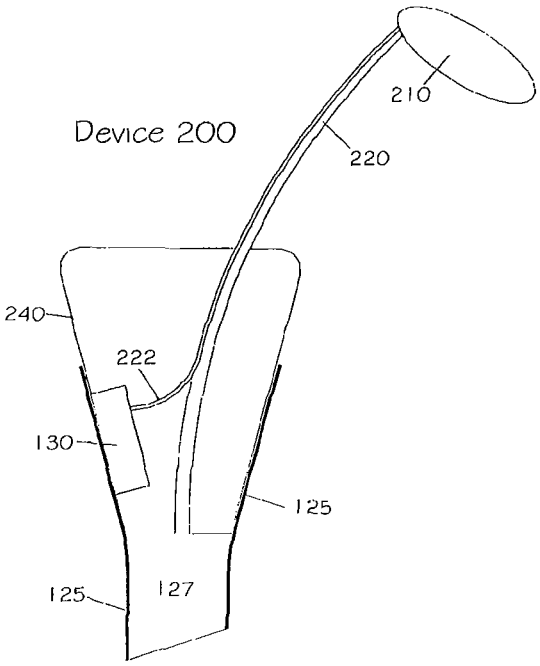
FIG. 2 illustrates a way to mount a MEMS accelerometer to the interior end of the device using a BTE (behind-the-ear) hearing assistance device according to one embodiment of the present subject matter.

The embodiment of FIG. 2 provides a way to mount a MEMS sensor 130 to the interior end of the device 200 using a BTE (behind-the-ear) hearing assistance device 210. The BTE 210 delivers sound through sound tube 220 to the ear canal 127 at the interior end of earmold 240. Sound tube 220 also contains an electrical conduit 222 for wired connectivity between the BTE and the MEMS sensor 130. The remaining operation of the device is largely the same as set forth for FIG. 1, except that the BTE 210 includes the microphone and electronics, and earmold 240 contains the sound tube 220 with electrical conduit 222 and MEMS sensor 130. The entire previous discussion pertaining to variations for the apparatus of FIG. 1 applies herein for FIG. 2. Other embodiments are possible without departing from the scope of the present subject matter.

Figure 3:
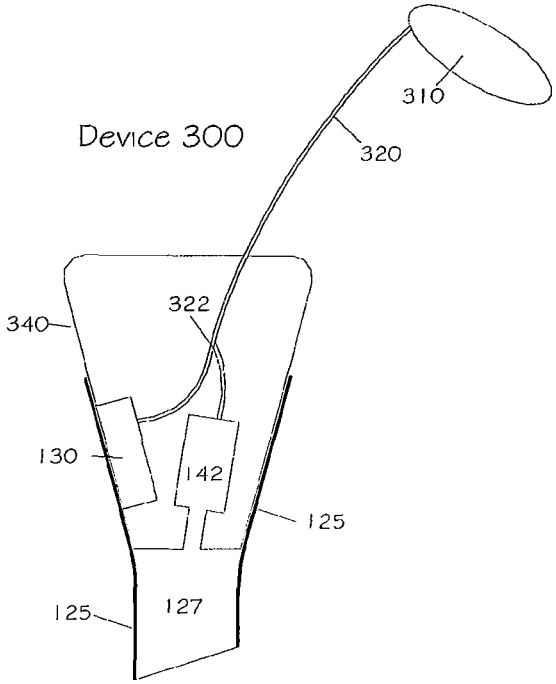
FIG. 3 illustrates a BTE providing an electronic signal to an earmold having a receiver according to one embodiment of the current subject matter.

The embodiment of FIG. 3 uses a BTE 310 to provide an electronic signal to an earmold 340 having a receiver 142. This variation permits a wired approach to providing the acoustic signals to the ear canal 142. The electronic signal is delivered through electrical conduit 320 which splits at 322 to connect to MEMS sensor 130 and receiver 142.

Figure 4:
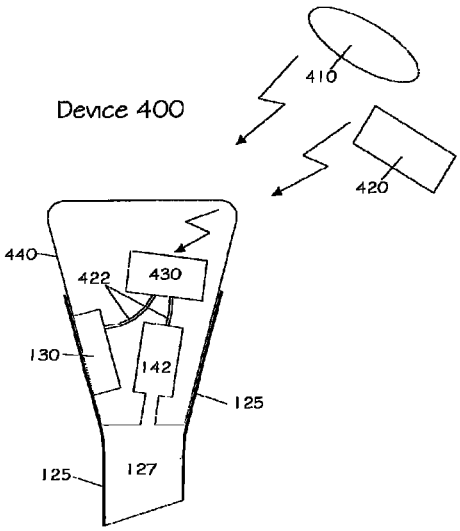
FIG. 4. illustrates a wireless earmold embodiment of the current subject matter.

The embodiment of FIG. 4, a wireless approach is employed, such that the earmold 440 includes a wireless apparatus for receiving sound from a BTE 410 or other signal source 420. Such wireless communications are possible by fitting the earmold with transceiver electronics 430 and power supply. The electronics 430 could connect to a receiver loudspeaker 142. In bidirectional applications, it may be advantageous to fit the earmold with a microphone to receive sound using the earmold. It is understood that many variations are possible without departing from the present subject matter.

Figure 5:
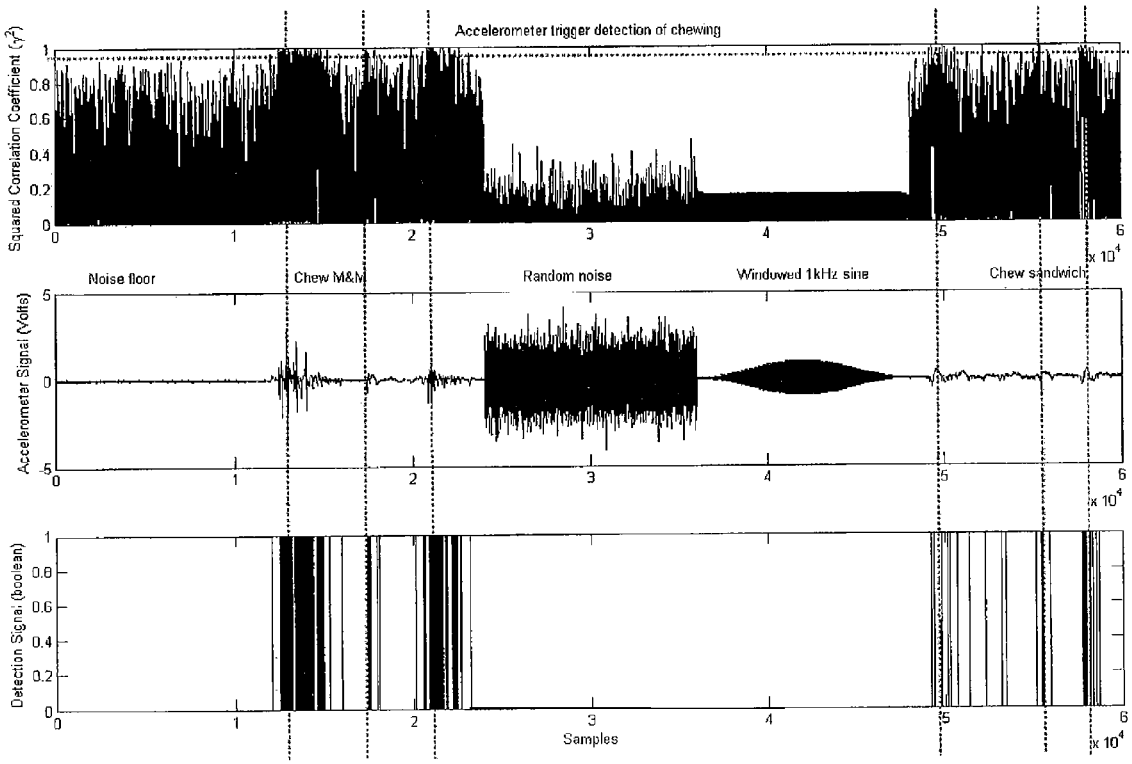
FIG. 5 illustrates typical timing relationships for detection of audio related motion events according to one embodiment of the current subject matter.

The middle panel of FIG. 5 shows the instantaneous output voltage of a MEMS accelerometer for a typical user activity such as (1) background circuit noise, (2) crunchy chewing, (3) synthetically generated random noise, (4) a synthetically derived 1 kHz, amplitude-modulated sinusoid, and (5) soft chewing. The top panel of FIG. 5 shows the instantaneous estimate of the squared correlation coefficient for each particular activity target according to one embodiment, with a horizontal dotted line depicting the detection threshold. The bottom panel shows a Boolean of the detection trigger according to one embodiment. All three panels are synchronized in time, and the vertical dotted lines depict the detection speed and precision of each chewing event.

The present subject matter relates to a MEMS accelerometer, however, it is understood that other accelerometer designs and MEMS sensors may be substituted for the MEMS accelerometer.

What is claimed is:

1. A hearing assistance apparatus adapted to be worn by a user having an ear and an ear canal, the apparatus for hearing assistance of the user, comprising:

a microphone for reception of sound and generating a sound signal;

a signal processor connected to the microphone, the signal processor adapted to process the sound signal for hearing assistance using a signal processing algorithm;

a memory connected to the signal processor and configured to store one or more predetermined user activity waveforms;

a micro electro-mechanical structure (MEMS) accelerometer adapted to measure mechanical vibration, the MEMS accelerometer connected to the signal processor; and a housing adapted to house the MEMS accelerometer, wherein the signal processor is adapted to process the sound signal using a signal from the MEMS accelerometer and the signal processing algorithm, and wherein the signal processor is adapted to compare the signal from the MEMS accelerometer to the one or more predetermined user activity waveforms and to identify a user activity based on the comparison.

2. The apparatus of claim 1, wherein the MEMS accelerometer is mounted integral to the wall of the housing.

3. The apparatus of claim 1, wherein the MEMS accelerometer is mounted flush with an exterior wall of the housing.

4. The apparatus of claim 1, wherein the housing is adapted to fit within the user's ear.

5. The apparatus of claim 4, further comprising a receiver connected to the signal processor.

6. The apparatus of claim 5, wherein the receiver is housed in the housing.

7. The apparatus of claim 6, further comprising wireless electronics connected to the MEMS sensor and the receiver, wherein the MEMS sensor and the receiver are connected to the signal processor through the wireless electronics.

8. The apparatus of claim 6, further comprising a second housing adapted to house the microphone and the signal processor.

9. The apparatus of claim 8, wherein the second housing is adapted to be worn behind the user's ear.

10. The apparatus of claim 5, wherein the housing is adapted to house the microphone and the signal processor.

11. The apparatus of claim 4, wherein the MEMS accelerometer includes a MEMS gyrator.

12. The apparatus of claim 11, further comprising a second housing adapted to house the microphone, the signal processor and the receiver.

13. The apparatus of claim 12, wherein the second housing is adapted to fit behind the user's ear.

14. The apparatus of claim 1, wherein the MEMS accelerometer is configured to detect translational acceleration in three dimensions.

15. The apparatus of claim 1, further comprising radio frequency communications electronics connected to the signal processor.

16. The apparatus of claim 1, wherein the signal processor includes a digital signal processor (DSP).

17. The apparatus of claim 1, wherein the signal processor is adapted to compute a correlation coefficient between the signal from the MEMS accelerometer and the one or more predetermined user activity waveforms.

18. The apparatus of claim 17, wherein the signal processor is adapted to identify a user activity based on a square of the correlation coefficient.

19. The apparatus of claim 1, wherein the signal processor is adapted to adjust one or more filters of the hearing assistance device to compensate for the identified user activity.

20. The apparatus of claim 1, wherein the signal processor is adapted to identify the user's speech based on the comparison.

* * * * *

UNITED STATES PATENT AND TRADEMARK OFFICE

CERTIFICATE OF CORRECTION

PATENT NO. : 8,767,989 B2
APPLICATION NO. : 12/233356
DATED : July 1, 2014
INVENTOR(S) : Burns et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1281 days.

Signed and Sealed this
Fourth Day of August, 2015

Michelle K. Lee

Michelle K. Lee
*Director of the United States Patent and Trademark Office*